US005594964A

United States Patent [19]

Boyd et al.

[11] Patent Number: 5,594,964

[45] Date of Patent: Jan. 21, 1997

[54] WATERBED MATTRESS COVER AND METHOD OF MAKING SAME

[75] Inventors: Dennis Boyd, Chesterfield, Mo.; Jeffrey J. Luchonok, Rancho Cucamonga; Alfredo D. Mayen, Torrance, both of Calif.

[73] Assignee: Boyd Flotation, Inc., Maryland Heights, Mo.

[21] Appl. No.: 365,015

[22] Filed: Dec. 28, 1994

[51] Int. Cl.[6] ..... A47C 27/08

[52] U.S. Cl. ..... 5/502; 5/737; 5/668; 112/2.1; 112/475.08

[58] Field of Search ..... 5/451, 470, 471, 5/452, 448, 502, 464; 112/475.08, 2.1

[56] References Cited

U.S. PATENT DOCUMENTS

| | | | |
|---|---|---|---|
| 10,861 | 8/1887 | Palmer | 112/475.08 X |
| 3,274,625 | 9/1966 | Metzger | 5/464 |
| 3,669,324 | 6/1972 | Landoni | 5/471 X |
| 4,145,780 | 3/1979 | Fogel | 5/350 |
| 4,149,286 | 4/1979 | Fogel | 5/370 |
| 4,186,455 | 2/1980 | Fox, Jr. et al. | 5/451 |
| 4,187,566 | 2/1980 | Peterson | 5/451 |
| 4,224,706 | 9/1980 | Young et al. | 5/449 |
| 4,301,561 | 11/1981 | McLeod | 5/496 |
| 4,656,681 | 4/1987 | Alexander et al. | 5/451 |
| 4,737,998 | 4/1988 | Johnson, Sr. | 5/422 |
| 4,742,788 | 5/1988 | Dugan | 112/475.08 |
| 4,757,564 | 6/1988 | Goodale | 5/448 |
| 4,970,743 | 11/1990 | Wride et al. | 5/451 |
| 5,144,707 | 9/1992 | Callaway et al. | 5/451 |
| 5,182,825 | 2/1993 | Stinson et al. | 5/451 |
| 5,195,196 | 3/1993 | Johenning et al. | 5/451 |

*Primary Examiner*—Michael F. Trettel
*Attorney, Agent, or Firm*—Polster, Lieder, Woodruff & Lucchesi

[57] ABSTRACT

A cover for a waterbed mattress includes a top layer suitably sized to cover the waterbed mattress and an inner backing layer of substantially the same overall outline as the top portion disposed so that the top layer lies over the backing layer. A bottom is spaced away from the top layer and the inner backing layer so as to provide a cavity for a water mattress, with the bottom disposed below the cavity and the inner backing layer being disposed above the cavity. The top layer is divided into at least three sections, each section extending substantially across the top layer. The first section is fixedly secured to the inner backing layer by stitches disposed in a first stitching pattern while the other two sections are fixedly secured to the inner backing layer by stitches disposed in a second stitching pattern. It is preferred that one of the stitching patterns be a continuous wave stitching pattern and that the other be a tack and jump stitching pattern. It is also preferred that the first section be disposed so as to support the lumbar section of a human user reclining thereon. The lumbar support section preferably extends somewhat higher above the mattress than the other two sections. In one embodiment, a variable density pad is disposed below the backing layer, with a more dense section of the pad disposed below the lumbar section of the top.

12 Claims, 3 Drawing Sheets

WATERBED MATTRESS COVER AND METHOD OF MAKING SAME

BACKGROUND OF THE INVENTION

This invention relates to waterbeds and more particularly to an improved cover for a waterbed mattress.

Waterbeds mattresses are known to provide many advantages in terms of comfort and restfulness. However, many waterbeds could be improved. The support provided by most waterbeds is uniform throughout, whereas the human body often has different support requirements in the lumbar region than in other regions. Moreover, the covers for conventional waterbed mattresses are often fairly resistant to stretching or elongation, or at most have a uniform degree of stretchability across the expanse of the cover. This fact is also related to comfort since comfort may be promoted by having a different degree of stretch in the lumbar regions than in other regions of the body.

SUMMARY OF THE INVENTION

Among the various objects and features of the present invention may be noted the provision of an improved waterbed mattress cover.

Another object is the provision of such a waterbed mattress cover with improved comfort and support.

A third object is the provision of such a waterbed mattress cover which provides differing mounts of support in different parts of the cover.

A fourth object is the provision of such a waterbed mattress cover which provides different degrees of stretchability in different parts of the cover.

A fifth object is the provision of an improved method of manufacturing the waterbed mattress cover of the present invention.

Other objects and features will be in part apparent and in part pointed out hereinafter.

Briefly, in a first aspect of the present invention, a cover for a waterbed mattress includes a top layer suitably sized to cover a waterbed mattress and an inner backing layer of substantially the same overall outline as the top portion. The inner backing layer is disposed so that the top layer lies over the backing layer. A bottom is spaced away from the top layer and the inner backing layer so as to provide a cavity for a water mattress, the bottom being disposed below the cavity and the inner backing layer being disposed above the cavity. The top layer is divided into at least three sections, each section extending substantially across the top layer. At least a first of the sections is fixedly secured to the inner backing layer by stitches disposed in a first stitching pattern, and at least a second of the sections is fixedly secured to the inner backing layer by stitches disposed in a second stitching pattern.

In a second aspect of the present invention, a method of making a cover for a waterbed mattress includes the step of placing an outer layer of material over a backing layer. The outer layer and the backing layer each have a body and a pair of selvage portions, the bodies also having at least first and second sections. The first section of the outer layer of material is stitched to the backing layer using a first stitching pattern, which first stitching pattern extends generally in a first direction across the body of the material. In addition, at least one selvage portion of the outer layer is stitched to the corresponding selvage portion of the backing layer using the first stitching pattern. Subsequently the second sections of the bodies are stitched together using a second stitching pattern. The stitched outer layer and backing layer are secured to a base. The stitched outer layer, backing layer and base form a cavity sized to accept a predetermined water mattress.

BRIEF DESCRIPTION OF THE DRAWINGS

Similar reference characters indicate similar parts throughout the several views of the drawings.

DESCRIPTION OF THE PREFERRED EMBODIMENTS

Figure 2:
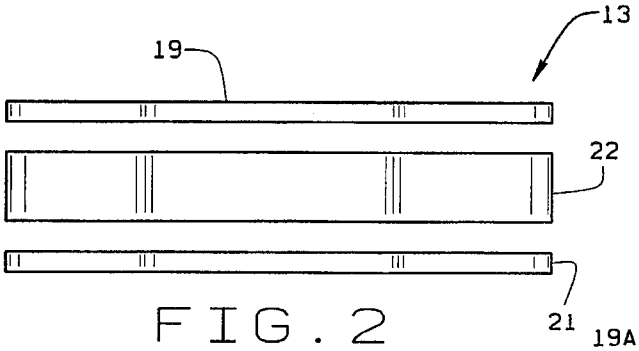
FIG. 2 is an exploded view of the top of the cover of FIG. 1.

Turning now to the drawings, a waterbed mattress cover 11 of the present invention includes a top 13, a bottom 15, and sides 17. As best seen in the exploded view of FIG. 2, top 13 includes a top layer 19 suitably sized to cover a waterbed mattress and an inner backing layer 21 of substantially the same overall outline as the top layer. The top and backing layers are disposed so that the top layer lies over the backing layer. It is preferred that the top layer be a suitable cloth fabric or the like to provide an appealing feel to the user. The backing layer may be made of any suitable material. If desired, a suitable filler layer 22 of material such as fiber, cotton, cashmere or the like may be disposed between top layer 19 and backing layer 21.

Figure 1:
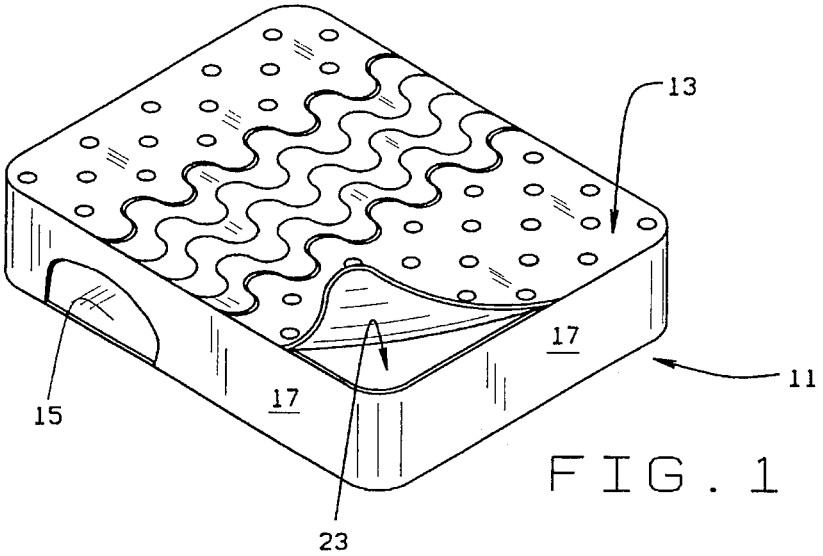
FIG. 1 is a perspective view of the waterbed mattress cover of the present invention.

As shown in FIG. 1, bottom 15 is spaced away from the top layer 19 and the inner backing layer so as to provide a cavity 23 for a waterbed mattress (not shown). Bottom 15 is disposed below cavity 23 and inner backing layer 21 is disposed above the cavity. As will appear, additional layers may be interposed between top layer 19 and cavity 23 if desired.

Figure 3:
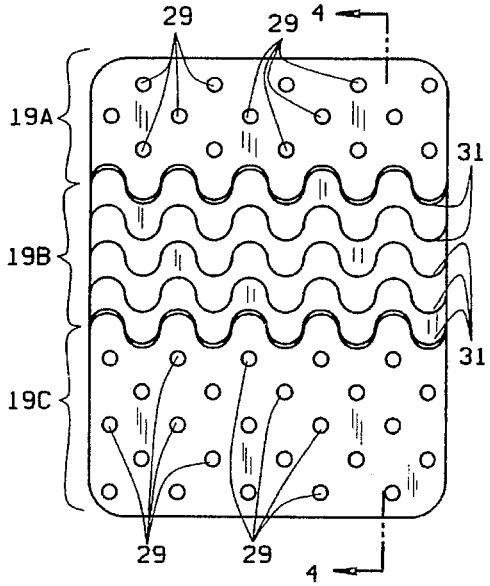
FIG. 3 is a top plan of the cover top of FIG. 2.

Top layer 19, as shown in FIG. 3 is divided into three sections, labeled 19A, 19B, and 19C, which extend substantially across the top layer. Sections 19A and 19C are fixedly secured to the corresponding portions of inner backing layer 21 by stitches disposed in a tack-and-jump stitching pattern, indicated by the dots 29 on FIG. 3, while section 19B is fixedly secured to the inner backing layer by stitches disposed in a different stitching pattern, such as the continuous wave stitch pattern shown in FIG. 3 at 31. It is preferred that the continuous stitching pattern have at least a first portion in which adjacent continuous wave stitches are close together, such as is shown in FIG. 3 at the top and bottom of section 19B, and a second portion (shown as the intermediate portion in FIG. 3) in which adjacent continuous wave stitches are spaced further apart.

Figure 4:
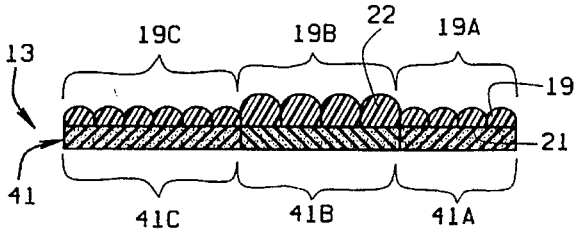
FIG. 4 is a sectional view, taken along line 4—4 of FIG. 3.

As can be seen in FIG. 4, filler layer 22, disposed between top layer 19 and backing layer 21, tends to make the top surface of top 13 uneven, the surface being depressed at the point of stitching and being relatively higher intermediate the stitching patterns. This unevenness can also be achieved in the absence of filler by suitable gathering of the top layer before stitching. It is preferred that the top surface of the top layer of section 19B, which corresponds to the lumbar area of the waterbed, extend higher than the top surface of the other two sections. This provides added comfort and support in the lumbar area. It is also preferred that top layer section 19B be expansible to a greater degree than the other sections of the top layer when a human user reclines upon the waterbed cover. This may be accomplished, for example, by providing additional material for the top layer in this section. Alternatively, the particular stitching pattern used, such as the continuous wave pattern shown, can provide more expandability longitudinally than the tack and jump pattern used in the other sections.

Figure 5:
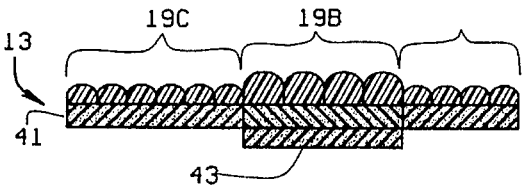
FIG. 5 is a view similar to FIG. 4 showing an alternative embodiment.

If desired, a pad 41 may be disposed below backing layer 21 but above the cavity 23. It is preferred that pad 41 be made of a suitable foam and have three zones 41A, 41B, and 41C corresponding to and disposed below the like-numbered sections of top layer 19. The zones extend across pad 41 transversely to the longitudinal axis thereof, and preferably zone 41B is of a higher density than the other two zones. This provides additional lumbar support for the user. Although .shown as distinct parts in the drawings, it should be understood that pad 41 may be formed as an integral unit with the variation in density of the various zones resulting from the manufacturing process. If desired, as shown in FIG. 5, an additional layer 43 of resilient material may be disposed adjacent zone 41B to provide even more support in the lumbar area.

Figure 6:
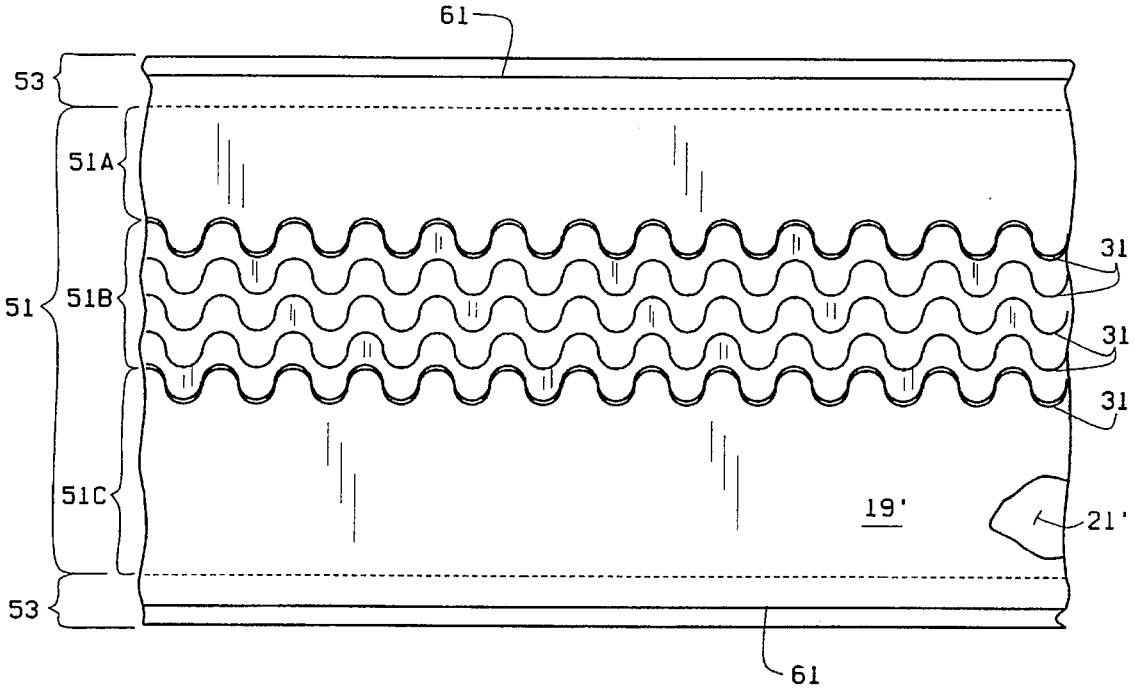
FIG. 6 is a top plan illustrating one stage in the manufacture of the cover top of FIG. 3.
Figure 7:
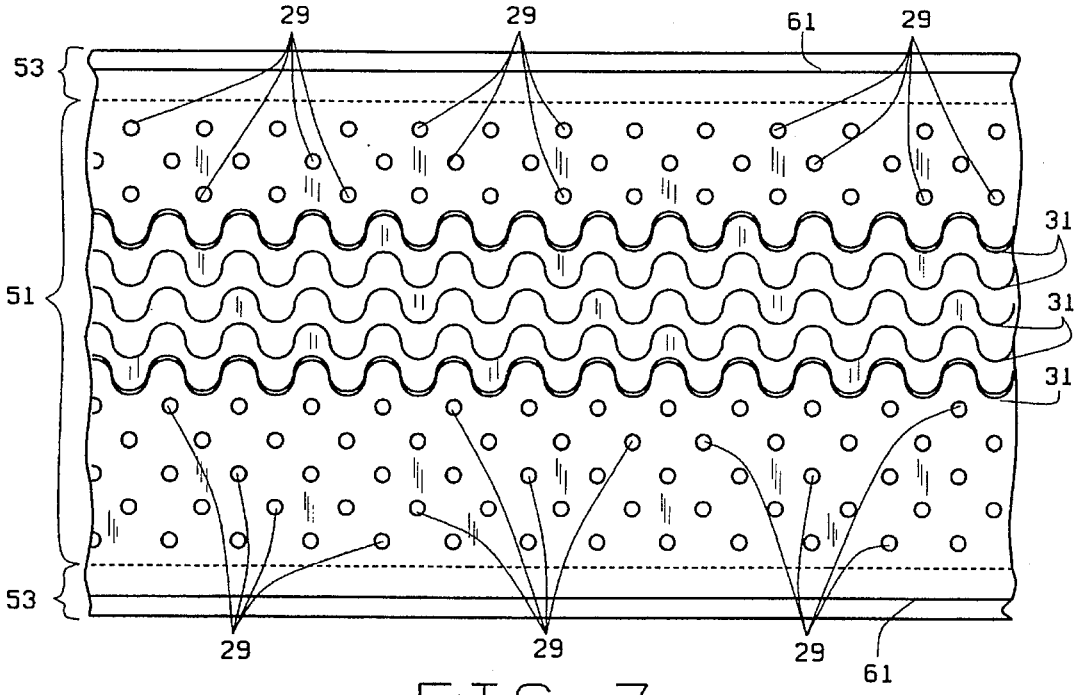
FIG. 7 is a view similar to FIG. 6 illustrating another stage in the manufacture.
Figure 8:
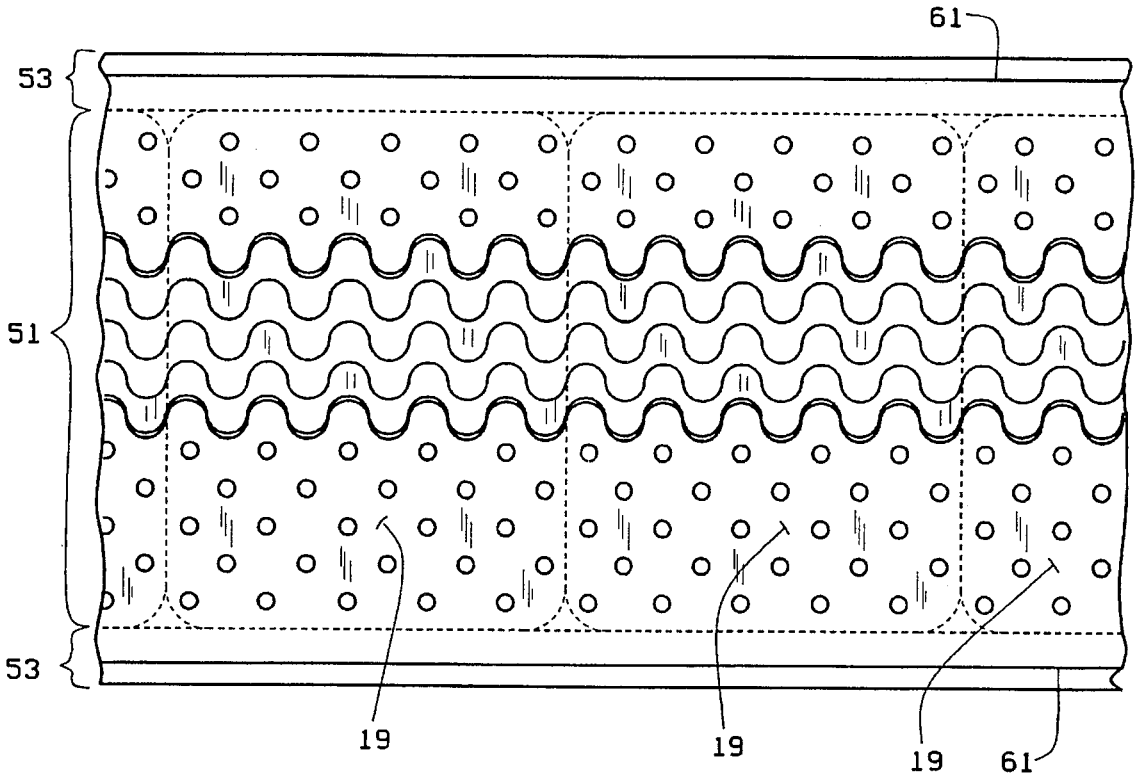
FIG. 8 is a view similar to FIGS. 6 and 7 illustrating a third stage in the manufacture.

Manufacture of the top 13 of cover 11 is illustrated in FIGS. 6–8. A long sheet of material 19' is placed over a sheet 21' of backing material, each sheet having a body portion 51 and a pair of selvage portions 53. Each body is divided into three sections 51A, 51B, and 51C, corresponding to sections 19A–19C discussed above. The sheets are fed into a continuous stitching machine, which sews them together (along with any filler material 22 (not shown) by means of stitches such as those indicated at 31 in FIG. 6. In addition, the stitching machine is used to provide additional stitches 61 in the selvage portions. Stitches 61 hold the various pieces together during subsequent tack and jump stitching operations.

The sheets, after they are stitched together as shown in FIG. 6, are subsequently put through a second stitching machine which adds the tack and jump stitches 29 shown in FIG. 7. Thereafter, selvage portions 53 are removed, the sheets are cut along the dashed lines shown in FIG. 8, and any needed finishing sewing is performed to create a completed top 13. Each of the plurality of tops made from a single run are then secured to the sides 17 and bottom 15 of the waterbed mattress cover in a conventional manner to form a cavity sized to accept a predetermined water mattress. If desired pad 41 can also be secured to top 13 before it is sewn into a completed mattress cover.

In view of the above, it will be seen that the various objects and features of the present invention are achieved and other advantageous results obtained. Numerous variations of the present invention are contemplated, so that the embodiments described herein are intended to be illustrative only and not to be taken in a limiting sense.

What is claimed is:

1. A cover for a waterbed mattress comprising:

a top layer suitably sized to cover a waterbed mattress, said top layer having a longitudinal axis;

an inner backing layer of substantially the same overall outline as the top layer and being disposed thereunder so that the top layer lies over the backing layer;

a bottom spaced away from the top layer and the inner backing layer so as to provide a cavity for a water mattress, said bottom being disposed below said cavity and said inner backing layer being disposed above said cavity;

said top layer being divided into at least three sections, each section extending substantially across the top layer transverse to the longitudinal axis, at least a first of said sections being fixedly secured to the inner backing layer by stitches disposed in a first stitching pattern, and at least a second of said sections being fixedly secured to the inner backing layer by stitches disposed in a second stitching pattern;

said bottom being substantially free of any stitching in either the first stitching pattern or the second stitching pattern;

wherein the second stitching pattern is a tack and jump stitching pattern.

2. A cover for a waterbed mattress comprising:

a top layer suitably sized to cover a waterbed mattress;

an inner backing layer of substantially the same overall outline as the top layer and being disposed thereunder so that the top layer lies over the backing layer;

a bottom spaced away from the top layer and the inner backing layer so as to provide a cavity for a water mattress, said bottom being disposed below said cavity and said inner backing layer being disposed above said cavity;

said top layer being divided into at least three sections each section extending substantially across the top layer, at least a first of said sections being fixedly secured to the inner backing layer by stitches disposed in a first stitching pattern and at least a second of said sections being fixedly secured to the inner backing layer by stitches disposed in a second stitching pattern;

wherein the top layer is stitched to the backing layer in such a manner that the surface of the top layer is uneven, the surface of the top layer in a first of the sections extending higher than in the other two sections.

3. The cover for a waterbed mattress as set forth in claim 2 wherein the section of the top layer having the higher surface is disposed between the other two sections.

4. The cover for a waterbed mattress as set forth in claim 2 wherein the top layer section having the higher surface is expansible to a greater degree than the other sections of the top layer when a human user reclines upon the waterbed cover.

5. The cover for a waterbed mattress as set forth in claim 1 further including a pad disposed between the backing layer and the cavity for the water mattress, said pad having at least three zones extending across the pad.

6. A cover for a waterbed mattress comprising:

a top layer suitably sized to cover a waterbed mattress;

an inner backing layer of substantially the same overall outline as the top layer and being disposed thereunder so that the top layer lies over the backing layer;

a bottom spaced away from the top layer and the inner backing layer so as to provide a cavity for a water mattress, said bottom being disposed below said cavity and said inner backing layer being disposed above said cavity;

said top layer being divided into at least three sections, each section extending substantially across the top layer, at least a first of said sections being fixedly secured to the inner backing layer by stitches disposed in a first stitching pattern, and at least a second of said sections being fixedly secured to the inner backing layer by stitches disposed in a second stitching pattern;

a pad disposed between the backing layer and the cavity for the water mattress, said pad having at least three zones extending across the pad;

wherein a first of the zones has a higher density than at least one of the other zones.

7. The cover for a waterbed mattress as set forth in claim 6 wherein said first zone has a higher density than both other zones.

8. The cover for a waterbed mattress as set forth in claim 6 wherein said first zone is disposed between the other zones.

9. The cover for a waterbed mattress as set forth in claim 6 wherein said first zone of the pad is disposed beneath the first section of said top layer.

10. A cover for a waterbed mattress comprising;

a top layer suitably sized to cover a waterbed mattress;

an inner backing layer of substantially the same overall outline as the top layer and being disposed thereunder so that the top layer lies over the backing layer;

a bottom spaced away from the top layer and the inner backing layer so as to provide a cavity for a water mattress, said bottom being disposed below said cavity and said inner backing layer being disposed above said cavity;

said top layer being divided into at least three sections, each section extending substantially across the top layer, at least a first of said sections being fixedly secured to the inner backing layer by stitches disposed in a first stitching pattern, and at least a second of said sections being fixedly secured to the inner backing layer by stitches disposed in a second stitching pattern;

a pad disposed between the backing layer and the cavity for the water mattress, said pad having at least three zones extending across the pad;

further including an additional layer of resilient material disposed adjacent only one of said zones.

11. A method of making a cover for a waterbed mattress comprising:

placing an outer layer of material over a backing layer, said outer layer and said backing layer each having a body and a pair of selvage portions, said bodies having at least first and second sections;

stitching the first section of the outer layer of material to the backing layer using a first stitching pattern, said first stitching pattern extending generally in a first direction across the body of the material, and stitching at least one selvage portion of the outer layer to the corresponding selvage portion of the backing layer using said first stitching pattern;

subsequently stitching the second sections of the bodies together using a second stitching pattern;

securing the stitched outer layer and backing layer to a base, said stitched outer layer, backing layer and base forming a cavity sized to accept a predetermined water mattress;

further including securing a pad adjacent the backing layer, said pad having at least first and second zones of different densities.

12. The method of making a cover for a waterbed mattress as set forth in claim 11 wherein the step of securing the pad includes securing the first zone of the pad adjacent the first section of the outer layer and backing layer.

* * * * *